US005544682A

United States Patent [19]

McDaniel

[11] Patent Number: 5,544,682

[45] Date of Patent: Aug. 13, 1996

[54] RESOLVATION SYSTEM FOR AN ACTIVE-INGREDIENT-CONTAINING LIQUID SOLUTION

[76] Inventor: Freddie B. McDaniel, 1104 Keysfr Ave., Natchitoches, La. 71457

[21] Appl. No.: 277,199

[22] Filed: Jul. 19, 1994

[51] Int. Cl.[6] ..... B65B 1/04; B65B 3/04

[52] U.S. Cl. ..... 141/9.000; 141/18; 141/100; 222/399; 239/310; 239/316

[58] Field of Search ..... 141/2, 9, 18, 100, 141/98; 222/399; 239/34, 310, 316; 4/227.1, 227.2, 227.3, 227.4, 227.5, 227.6, 227.7, 225.1, 226.1

[56] References Cited

U.S. PATENT DOCUMENTS

| | | | |
|---|---|---|---|
| 1,681,362 | 9/1924 | Pike | 239/310 |
| 1,964,576 | 6/1932 | Horne | 239/310 |
| 2,874,032 | 2/1959 | Kuehner | 23/267 |
| 3,053,422 | 9/1962 | Tenison et al. | 222/399 |
| 3,061,842 | 8/1962 | Woodruff | 4/225.1 |
| 3,162,372 | 12/1964 | Viard | 239/354 |
| 3,698,605 | 10/1972 | Quisling | 222/190 |
| 3,837,017 | 9/1974 | McDuffee | 4/227.1 |
| 4,382,304 | 5/1983 | Lehmann | 4/227.1 |
| 4,597,941 | 4/1986 | Bottom et al. | 4/227.1 |
| 4,621,770 | 11/1986 | Sayen | 239/304 |
| 5,286,126 | 2/1994 | Harris et al. | 401/82 |

*Primary Examiner*—Henry J. Recla
*Assistant Examiner*—Timothy L. Maust
*Attorney, Agent, or Firm*—Kolisch Hartwell Dickinson McCormack & Heuser

[57] ABSTRACT

A resolvation system for an active-ingredient-containing liquid solution includes an amount of solid having an active ingredient and container structure for holding both the solid and a first volume of liquid solvent. The solvent is capable of solvating a first portion of the solid to release a first charge of the active ingredient into the first volume of solvent to make a first active-ingredient-containing solution. Also included is liquid-emission structure associated with the container structure and including actuator substructure actuable by such user to emit a desired amount of the solution to a desired target area. The amount of solid exceeds that which can be dissolved into the first volume of solvent, and the container structure includes a removable closure device. The system may be designed so that the amount of solid exceeds that which can be dissolved into the first and second volumes of solvent, thereby to accommodate successive addition of more volumes of solvent into the container structure after the user has emitted at least some of the active-ingredient-containing solutions present in the container structure. The system may be designed as a deodorant resolvator for a liquid solution containing an active ingredient that tends to kill odor-causing-bacteria. A method of successively solvating a solid containing an active ingredient is also described.

9 Claims, 1 Drawing Sheet

RESOLVATION SYSTEM FOR AN ACTIVE-INGREDIENT-CONTAINING LIQUID SOLUTION

BACKGROUND AND SUMMARY OF THE INVENTION

The present invention relates generally to liquid solutions containing active ingredients for various uses. More particularly, the invention concerns a novel resolvation system for liquid solutions containing active ingredients that tend to kill odor-causing bacteria.

Active ingredients are manufactured and sold in solid or liquid form as intermediate products that are dissolved into corresponding solvents ultimately for application to a desired treatment area. Such active ingredients are available for a wide variety of applications including use as pesticides, insecticides, fertilizers, perfumes, deodorants, and food additives.

A procedure is known for dissolving an active ingredient into a liquid solvent to change the liquid chemically for a desired purpose. For example, many conventional pesticides, insecticides and fertilizers are made with an active ingredient, in a solid or liquid state, that is subsequently dissolved into a suitable liquid solvent by a user ultimately to apply the mixture to a desired location, e.g. certain regions of a plant or lawn.

That same procedure is used in food chemistry to incorporate food additives, such as vanilla or other nut/bean extracts, into various recipes. It is also used for various medical applications as well as in the fragrance and personal-care-products industry.

There are certain drawbacks with conventional methods of making the intermediate active ingredient available to the user ultimately for dissolution into an appropriate solvent. First, many active ingredients are sold in bulk quantities that require undesired time and effort in measuring appropriate amounts per use, and in mixing such amounts into an appropriate solvent. Second, certain active ingredients are relatively toxic, or at least unappealing to touch/smell, so that the measure/mix activity carries a safety risk or causes discomfort for the user.

Additional drawbacks include the relatively limited use, with respect to time or amount, of an active-ingredient-containing solution after the arduous mixing/measuring required by most of such conventional methods. Time limitations are present because certain active-ingredient-containing solutions have a fixed-use life, e.g. certain solution use lives can be only a matter of minutes or hours. Amount limitations are present for non-bulk quantity usage of such products. That is, where a small container is provided in a prepackaged, premixed form, its usefulness is obviously limited by the quantity in the package.

In the deodorant industry, it is known to make solid or liquid deodorant formulations with the active ingredient already dissolved in the formulation. Such formulations are then suitably packaged for use by a consumer. These formulations have the limitation of single-package use, i.e. once a package/container of deodorant is used up, the active ingredient is completely gone, as is the carrier/solvent.

With respect to aerosol dispensers for deodorants, there has been a certain suggestion to make them reusable by allowing for successive addition of a solvent and a solid tablet into a suitable opaque aerosol container. The tablet is formulated to produce (1) gas necessary for dispensing the product and (2) an active ingredient for making the product capable of deodorizing. Such apparatus has the drawback of requiring similar, albeit simplified, measuring/mixing activity when reusing the aerosol container. Another drawback is that the user cannot visibly monitor when the deodorant solution is in need of replenishment. For environmental reasons, aerosol dispensing apparatus is also undesirable generally.

None of the above conventional methods and/or products is designed for multiple usage of an active-ingredient-containing package by simply adding an appropriate solvent.

Accordingly, it is a principal object of the present invention to provide a system for using an active-ingredient-containing solution which overcomes the drawbacks of prior-art proposals.

Another object is to provide such a system that accommodates use/reuse by simply successive addition of a suitable solvent.

Yet another object is to provide such a system that allows a user visibly to monitor whether the system should be refilled with more solvent.

Another important object of the invention is to provide such a system for a deodorant product where the active ingredient is itself visible and is provided in a form that is attractive to consumers.

It is also an object of the invention to provide such a system that can be cost-effectively manufactured.

In brief summary, one aspect of the invention includes a resolvation system for an active-ingredient-containing liquid solution. The invention includes an amount of solid having an active ingredient and container structure for holding both the solid and a first volume of liquid solvent. The solvent is capable of solvating a first portion of the solid to release a first charge of the active ingredient into the first volume of solvent to make a first active-ingredient-containing solution. Also included is liquid-emission structure associated with the container structure and including actuator substructure actuable by such user to emit a desired amount of the solution to a desired target area.

The invention requires that the amount of solid exceeds that which can be dissolved into the first volume of solvent, and that the container structure includes a removable closure device. The idea is to accommodate reopening of the container structure for addition of a second volume of liquid solvent into the container structure after the user has emitted at least some of the first active-ingredient-containing solution. The addition of the second volume of solvent causes release of a second charge of the active ingredient into the solvent to make a second active-ingredient-containing solution which the user can emit, via the liquid-emission structure, in desired amounts to desired target areas. The system of the invention is preferably designed so that the amount of solid exceeds that which can be dissolved into the first and second volumes of solvent, thereby to accommodate successive addition of more volumes of solvent into the container structure after the user has emitted at least some of the active-ingredient-containing solutions present in the container structure.

Another aspect of the invention is to provide a deodorant resolvator for a liquid solution containing an active ingredient that tends to kill odor-causing-bacteria. The resolvator preferably includes container structure that is constructed from visible-light-transmissive material, and an amount of solid having an active ingredient with the solid being configured in plural crystal forms.

Yet another aspect of the invention is to provide a method of successively solvating a solid containing an active ingredient. The method of the invention includes the steps of selecting an amount of solid having an active ingredient, and placing the amount of solid in container structure. Other steps include (1) adding a first volume of liquid solvent capable of solvating a first portion of the solid to release a first charge of the active ingredient into the first volume of solvent to make a first active-ingredient-containing solution, and (2) emitting a desired amount of the first solution to a desired target area. Another step involves replacing the emitted solution by adding a second volume of liquid solvent to the container structure after performing the emitting step, with the addition of the second volume of solvent causing release of a second charge of the active ingredient into the solvent to make a second active-ingredient-containing solution. The invention also requires the step of re-emitting a desired amount of the second solution to a desired target area.

The method of the invention preferably also includes the step of repeating the replacing and re-emitting steps for additional volumes of solvent ultimately to make additional active-ingredient-containing solutions for application to desired target areas.

These and other objects and advantages of the invention will be more clearly understood from a consideration of the accompanying drawings and the following description of the preferred embodiment.

DETAILED DESCRIPTION OF THE PREFERRED EMBODIMENT

Figure 1:
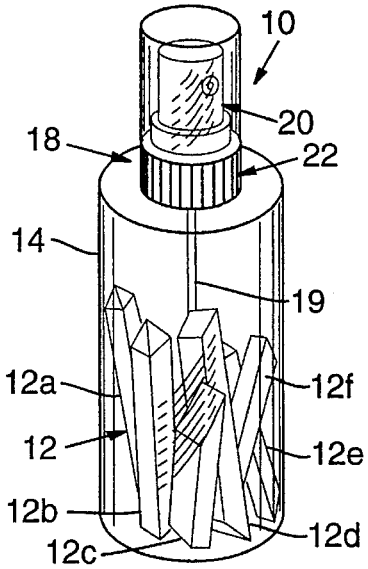
FIG. 1 is an isometric view showing the preferred embodiment of the resolvation system of the present invention.
Figure 2:
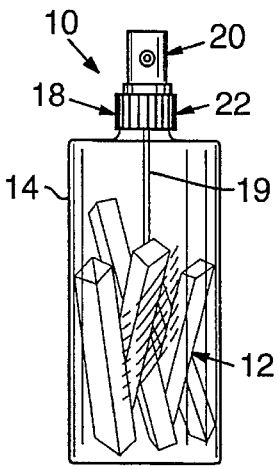
FIG. 2 is a front-elevation view of the system shown in FIG. 1.
Figure 3:
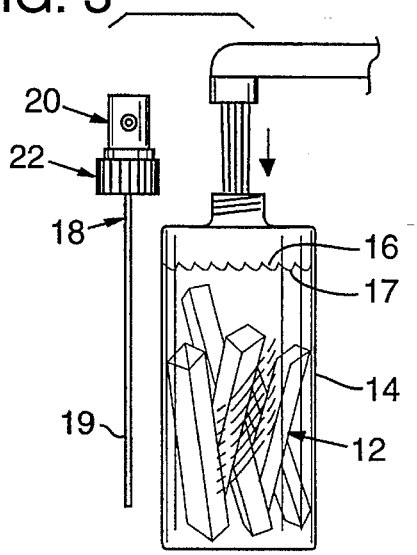
FIG. 3 is another elevational view showing how the system is filled with a first volume of liquid solvent ultimately for initial use by a user.
Figure 4:
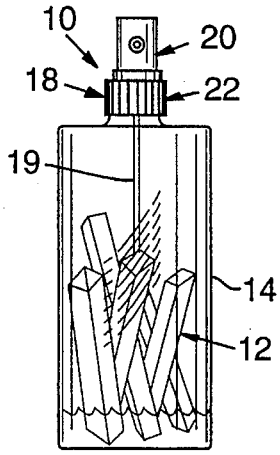
FIG. 4 depicts the system shown in FIG. 3 after an amount of the first volume has been used.

Referring to FIGS. 1–2, the resolvation system of the present invention is shown being made in accordance with its preferred embodiment and indicated at 10. System 10 includes an amount of solid 12 having an active ingredient (undepicted) and a container structure, or bottle, 14 for holding both solid 12 and to-be-described solvent. Referring to FIG. 3 a first volume 16 of liquid solvent is added to bottle 14. The solvent is chosen to be capable of solvating a first portion of the solid to release a first charge of the active ingredient into the first volume of solvent to make a first active-ingredient-containing solution 17. After a certain amount of time activated-ingredient-containing solution 17 will become saturated with an equilibrium quantity of active ingredient. It has been found that an active-ingredient-saturated solution is obtained at room temperature by either vigorous shaking of the system for about 30 seconds, or by allowing the system to sit overnight.

Referring to FIGS. 1–3, system 10 also includes a liquid-emission structure 18 associated with container structure 14 and including an actuator substructure 20, such as a conventional spray pump, actuable by the user to emit a desired amount of the solution to a desired target area. The target area depends on the application, e.g. a plant if it is a pesticide application, a human underarm if it is a deodorant application. Liquid-emission structure 18 also includes a tube 19 which is inserted into active-ingredient-containing solution 17. In the preferred embodiment tube 19 extends about halfway down into bottle 14 to (1) simplify insertion of tube 19 around solid 12, and (2) limit the tendency of tube 19 to become plugged by a small piece(s) of solid 12.

Figure 5:
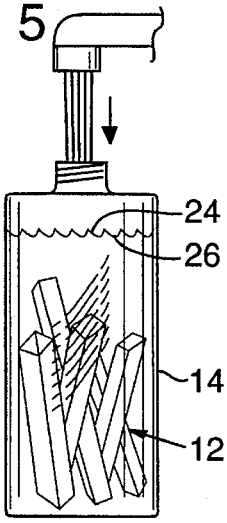
FIG. 5 shows a second volume of liquid solvent being added to the system.
Figure 6:
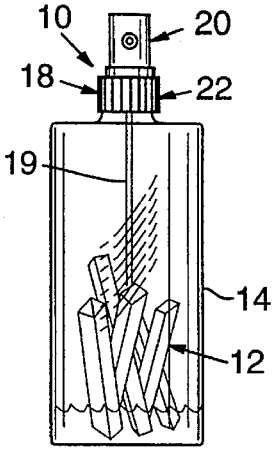
FIGS. 6–11 show additional views of the system after successive usage of additional volumes of liquid solvent and refilling/adding additional volumes of such solvent.
Figure 7:
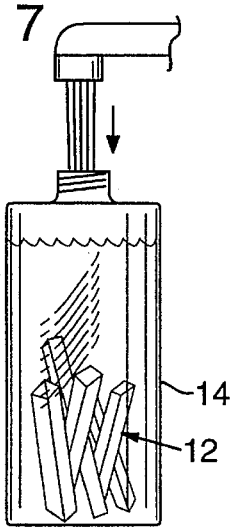
Figure 8:
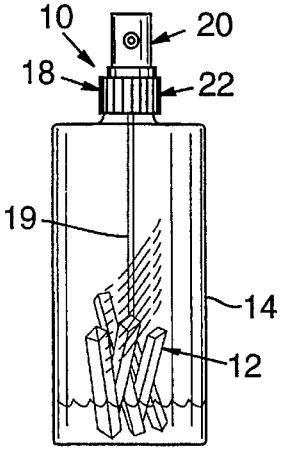
Figure 9:
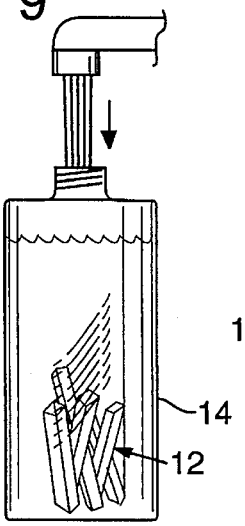
Figure 10:
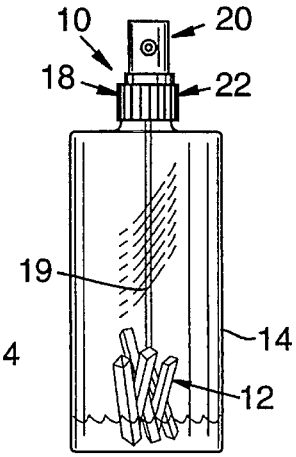
Figure 11:
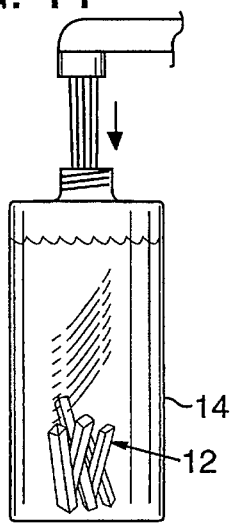

The invention requires that the amount of solid exceeds that which can be dissolved into first volume 16, and that bottle 14 includes a removable closure device, such as a screw top, or lid, 22. The idea is to accommodate reopening of the bottle (FIG. 5) for addition of a second volume 24 (FIG. 5) of liquid solvent into the bottle after the user has emitted at least some of first active-ingredient-containing solution 17. The addition of second volume 24 causes release of a second charge of the active ingredient into the solvent to make a second active-ingredient-containing solution 26 which the user can emit, via the liquid-emission structure, in desired amounts to desired target areas.

System 10 is preferably designed so that the amount of solid exceeds that which can be dissolved into the first and second volumes of solvent, thereby to accommodate successive addition of more volumes of solvent into the container structure after the user has emitted at least some of the active-ingredient-containing solution present in the container structure. FIGS. 6–11 depict such successive addition of more volumes (FIGS. 7, 9 and 11) of solvent after the solution level drops (FIGS. 6, 8 and 10) as a result of it being emitted from the system via liquid-emission structure 18.

A particularly appropriate application of the invention is as a deodorant resolvator for a liquid solution containing an active ingredient that tends to kill odor-causing-bacteria. The resolvator includes all components described above and system 10 may also be thought of as resolvator 10. Preferably bottle 14 of resolvator 10 is constructed from visible-light-transmissive material such as a clear suitable plastic, and solid 12 is configured either in plural crystal forms **12*a–f*, or as a single, relatively large piece which is cut to fill at least about 30% of the volume of bottle 14. If solid 12 is configured in plural crystal forms 12*a–f*, these forms may be approximately ¼-inch to 1 ½-inches in diameter. The crystal forms preferably have sharp edges and have the appearance of natural crushed rock. Alternatively, the crystal forms have a natural river rock appearance with relatively round edges and relatively smooth surfaces. Also alternatively, the crystal forms may be up to about ¼-inch in diameter to achieve a more grainy or powdery appearance. If solid 12** is configured as a single large piece, this piece may be cut round, oval, square, facet, or some combination of all of the above. Regardless of the cut or size of the solid, its appearance can vary from icy clear to chalky white.

Resolvator 10 could be packaged for sale with or without first volume 16 in it.

For a 100 ml bottle, it has been found that 80 grams of solid 12 provide enough solid (and necessary active ingredient) for more than twelve refills of the bottle with tap water. For the deodorant application, the preferred active ingredient is aluminum ammonium sulfate, however, aluminum chlorohydrate and potassium aluminum sulfate may also be used as active ingredients. The aluminum ammonium sulfate is available commercially in a mineral crystal from Numchai of 1820/291-2 Charansanitwong Road Bang Plod, BangkokNo 1 Bangkok, Thailand 10700.

Generally speaking, as long as the amount of solid exceeds that which can be dissolved in the volume of bottle 14, solution 17 will ultimately reach the same concentration of active ingredient (the equilibrium quantity of solid 12 when it is saturated in solution) regardless of how much solvent is added in a refill. Thus, there is no need to carefully measure the appropriate amount of solvent or solid when refilling the container structure.

The crystal forms of solid 12 preferably retain their shape, form and appearance until they are completely dissolved. In other words, they do not crumble or turn to a sludge, but instead retain their general crystalline form as they decrease in size and dissolve.

While undepicted, bottle 14 may be constructed as two parts, an upper part and a lower part, which parts are sealed during manufacture. The lower part has an open top that accommodates insertion of relatively large solids. During production of the system with a two-part bottle, either the solid, or the liquid, or both, can be cost-effectively placed in the lower part, and then the top part can be suitably sealed to the lower part. Preferably, such sealing is accomplished with solvents or with high-frequency radiation.

Another version of the two-part bottle includes configuring the lower part and upper part to be repeatably sealed together manually such as by screwing. This enables a user to unseal (e.g. unscrew) the two parts and replenish solid 12. The capability of replenishing solid 12 makes almost unlimited the number of times resolvation system 10 can be reused.

Operation and Preferred Method of Practicing the Invention

In use, resolvator 10 can be held easily in the user's hand and applied to a desired area of the user's body by actuating liquid-emission structure 18 via spray pump 20. After using resolvator 10, closure device 22 may be removed from bottle 14 and second volume 24 of tap water may be added. After reclosing the bottle, resolvator 10 may be reused. Multiple refillings are possible. It is also contemplated that bottle 14 may be manufactured without including first volume 16 of water, which will require that the consumer add the first volume to bottle 14 at home using tap water.

Put another way, the method of the invention is for successively solvating a solid containing an active ingredient. The method includes the steps of selecting an amount of solid 12 having an active ingredient, and placing solid 12 in bottle 14. Other steps include (1) adding a first volume 16 of liquid solvent capable of solvating a first portion of the solid to release a first charge of the active ingredient into the first volume of solvent to make a first active-ingredient-containing solution 17, and (2) emitting a desired amount of first solution 17 to a desired target area. Another step involves replacing the emitted solution by adding second volume 24 of liquid solvent to bottle 14 after performing the emitting step, with the addition of second volume 24 causing release of a second charge of the active ingredient into the solvent to make a second active-ingredient-containing solution 26. The method of the invention also requires the step of re-emitting a desired amount of second solution 26 to a desired target area.

The present invention therefore achieves the above objects by providing novel resolvation system 10 for an active-ingredient-containing liquid solution that overcomes the drawbacks of prior-art proposals. System 10 accommodates reuse by simply successive addition of a suitable solvent, such as tap water for the deodorant-resolvator version of the invention. Deodorant resolvator 10 also allows a user visibly to monitor whether the system should be refilled with more solvent via clear plastic bottle 14 and the easily noticeable configuration of solid 12 as crystals 12*a–f* (FIG. 1). The crystals are also attractive to consumers of deodorants. Based upon the material choices for resolvator 10, it can also be cost-effectively manufactured.

Accordingly, while a preferred embodiment of the invention has been described herein, it is appreciated that modifications are possible that are within the scope of the invention.

It is claimed and desired to secure by Letters Patent:

1. A deodorant resolvator for a liquid solution containing an active ingredient that tends to kill odor-causing-bacteria, comprising:

an amount of a solid including only a soluble active ingredient that tends to kill odor-causing-bacteria, the amount of solid being formed as plural crystal rocks;

container structure for holding both the solid and a first volume of liquid solvent capable of solvating a first portion of the solid to release a first charge of the active ingredient into the first volume of solvent to make a first active-ingredient-containing solution, wherein the container structure is constructed from visible-light-transmissive material for a user to determine when an additional volume of liquid solvent and an additional amount of solid may be added to the container structure; and a removable closure device associated with the container structure, wherein removal of the closure device accommodates addition of additional volumes of liquid solvent into the container structure and closure of the closure device prevents entry of additional volumes of liquid solvent into the container structure;

wherein the closure device includes liquid-emission structure having actuator substructure actuable by such user to emit a desired amount of the solution to a desired target area, wherein entry of additional volumes of solvent into the container structure via the removable closure device produces no emission of the solution from the container structure via the liquid-emission structure;

wherein the amount of solid exceeds that which can be dissolved into the first volume of solvent, and the removable closure device being configured to accommodate addition of a second volume of liquid solvent into the container structure after the user has emitted at least some of the first active-ingredient-containing solution, with the addition of the second volume of solvent causing release of a second charge of the active ingredient into the solvent to make a second active-ingredient-containing solution which the user can emit, via the liquid-emission structure, in desired amounts to desired target areas; and wherein the amount of solid completely dissolves after addition of multiple subsequent volumes of liquid solvent into the container structure such that no amount of solid remains in the container structure.

2. The resolvator of claim 1, wherein the active ingredient is selected from the group consisting of aluminum ammonium sulfate, aluminum chlorohydrate and potassium aluminum sulfate.

3. The resolvator of claim 1, wherein the liquid solvent is water.

4. The resolvator of claim 1, wherein the actuator substructure is a spray pump.

5. The resonator of claim 2, wherein the active ingredient being selected from the group consisting of aluminum ammonium sulfate, aluminum chlorohydrate and potassium aluminum sulfate.

6. The resolvator of claim 2, wherein the liquid solvent is water.

7. The resolvator of claim 2, wherein the actuator substructure is a spray pump.

8. A method of successively solvating a solid containing an active ingredient that tends to kill odor-causing-bacteria, comprising:

selecting an amount of solid having an active ingredient, the amount of solid being plural crystal rocks;

removing a closure device associated with the container structure so that the amount of solid may be placed into a container structure and so that a volume of liquid solvent may be added to the container structure;

placing each of the crystal rocks in the container structure;

adding a first volume of liquid solvent capable of solvating a first portion of the solid to release a first charge of the active ingredient into the first volume of solvent to make a first active-ingredient-containing solution;

closing the closure device to prevent entry of additional volumes of solvent to the container structure;

emitting a desired amount of the first solution to a desired target area;

replacing the emitted solution by removing the closure device, adding a second volume of liquid solvent to the container structure after performing the emitting step and then re-closing the closure device, with the addition of the second volume of solvent causing release of a second charge of the active ingredient into the solvent to make a second active-ingredient-containing solution;

re-emitting a desired amount of the second solution to a desired target area; and repeating the replacing and re-emitting steps for additional volumes of solvent ultimately to make additional active-ingredient-containing solutions for application to desired target areas until the amount of solid completely dissolves, such that no amount of solid remains in the container structure.

9. A deodorant resolvator for a liquid solution containing an active ingredient that tends to kill odor-causing-bacteria, comprising:

an amount of a solid including a soluble active ingredient that tends to kill odor-causing-bacteria, the amount of solid being plural crystal rocks;

container structure for holding both the solid and a first volume of liquid solvent capable of solvating a first portion of the solid to release a first charge of the active ingredient into the first volume of solvent to make a first active-ingredient-containing solution, wherein the container structure is constructed from visible-light-transmissive material for a user to determine when additional volumes of liquid solvent needs to be added to the container structure and to determine when an additional amount of solid needs to be added to the container structure; and removable closure device associated with the container structure, wherein removal of the closure device accommodates addition of additional volumes of liquid solvent into the container structure and closure of the closure device prevents entry of additional volumes of liquid solvent into the container structure;

wherein the closure device includes a liquid-emission structure having an actuator substructure actuable by such user to emit a desired amount of the solution to a desired target area, wherein entry of additional volumes of solvent into the container structure via the removable closure device produces no emission of the solution from the container structure via the liquid-emission structure; and wherein the amount of solid exceeds that which can be dissolved into the first volume of solvent, and the removable closure device being configured to accommodate addition of a second volume of liquid solvent into the container structure after the user has emitted at least some of the first active-ingredient-containing solution, with the addition of the second volume of solvent causing release of a second charge of the active ingredient into the solvent to make a second active-ingredient-containing solution which the user can emit, via the liquid-emission structure, in desired amounts to desired target areas.

* * * * *